US005844359A

United States Patent [19]

Watkins

[11] Patent Number: 5,844,359

[45] Date of Patent: Dec. 1, 1998

[54] LIGHTWEIGHT BACK PLATE FOR FED AND FLAT CRT VACUUM ENVELOPES

[75] Inventor: Charles M. Watkins, Meridian, Id.

[73] Assignee: Micron Display Technology, Inc., Boise, Id.

[21] Appl. No.: 599,442

[22] Filed: Jan. 18, 1996

[51] Int. Cl.[6] ..... H01J 9/24

[52] U.S. Cl. ..... 313/495; 445/24; 65/59.7

[58] Field of Search ..... 445/24, 25; 313/495, 313/496, 497; 65/59.7

[56] References Cited

U.S. PATENT DOCUMENTS 4,563,617 1/1986 Davidson ..... 313/513

5,198,723 3/1993 Parker ..... 313/493

5,589,731 12/1996 Fahlen et al. ..... 313/495

*Primary Examiner*—Kenneth J. Ramsey

*Attorney, Agent, or Firm*—Hale and Dorr LLP

[57] ABSTRACT

A process is provided for strengthening a backplate of a field emission display. In one embodiment, the process comprises, disposing a plurality of attachments on a surface of the backplate, disposing a strengthening member along the surface of the backplate, and attaching the strengthening member to the attachments. In another embodiment, a field emission display is provided having a backplate comprising, a plurality of attachments on a surface of the backplate, and a strengthening member disposed along the surface of the backplate, wherein the strengthening member is connected to the attachments.

12 Claims, 4 Drawing Sheets

FIELD EMISSION DISPLAY
CROSS SECTION

LIGHTWEIGHT BACK PLATE FOR FED AND FLAT CRT VACUUM ENVELOPES

GOVERNMENT RIGHTS

This invention was made with Government support under Contract No. DABT 63-93-C-0025 awarded by Advanced Research Projects Agency (ARPA). The Government has certain rights in this invention.

BACKGROUND OF THE INVENTION

This invention relates to the field of electronic displays, and, more particularly, field emission display ("FED") devices.

As technology for producing small, portable electronic devices progresses, so does the need for electronic displays which are small, provide good resolution, and consume small amounts of power in order to provide extended battery operation. Past displays have been constructed based upon cathode ray tube ("CRT") or liquid crystal display ("LCD") technology. However, neither of these technologies is perfectly suited to the demands of current electronic devices.

CRT's have excellent display characteristics, such as, color, brightness, contrast and resolution. However, they are also large, bulky and consume power at rates which are incompatible with extended battery operation of current portable computers.

LCD displays consume relatively little power and are small in size. However, by comparison with CRT technology, they provide poor contrast, and only limited ranges of viewing angles are possible. Further, color versions of LCDs also tend to consume power at a rate which is incompatible with extended battery operation.

As a result of the above described deficiencies of CRT and LCD technology, efforts are underway to develop new types of electronic displays for the latest electronic devices. One technology currently being developed is known as "field emission display technology." The basic construction of a field emission display, or ("FED") is shown in FIG. 1. As seen in the figure, a field emission display comprises a faceplate 100 with a transparent conductor 102 formed thereon. Phosphor dots 112 are then formed on the transparent conductor 102. The face plate 100 of the FED is separated from a baseplate 114 by a spacer 104. The spacers serve to prevent the baseplate from being pushed into contact with the faceplate by atmospheric pressure when the space between the baseplate and the faceplate is evacuated. A plurality of emitters 106 are formed on the baseplate. The emitters 106 are constructed by thin film processes common to the semi-conductor industry. Millions of emitters 106 are formed on the baseplate 114 to provide a spatially uniform source of electrons.

However, the faceplates and backplates, also referred to generically as substrates, used in typical FED and flat panel displays made from glass, or some other relatively brittle material. This creates several problems. For example, in order to provide sufficient mechanical strength, the substrate must be made relatively thick. Since these substrates are relatively dense materials, increasing the thickness also causes a proportionate increase in the weight of the device. Moreover, the substrates are also susceptible to breakage, not only from mechanical impact, but also due to the atmospheric pressure on the outside of the substrates when the space between them is evacuated. Therefore, spacers must be provided between the substrates which increases the cost and difficulty of the manufacturing device. Therefore, there is a need in the art for a substrate which will overcome the above-mentioned problems.

SUMMARY OF THE INVENTION

According to the present invention, a process is provided for strengthening a substrate of a field emission display. In one embodiment, the process comprises, disposing a plurality of attachments on a substrate surface, disposing a strengthening member along the substrate surface, and connecting the strengthening member to the attachments.

According to another embodiment of the invention, there is provided a field emission display having a substrate comprising a plurality of attachments on a substrate surface, and a strengthening member disposed along the substrate surface, wherein the strengthening member is connected to the attachments.

BRIEF DESCRIPTION OF THE DRAWINGS

For a more complete understanding of the invention and for further advantages thereof, reference is made to the following Detailed Description taken in conjunction with the accompanying drawings, in which.

It is to be noted, however, that the appended drawings illustrate only typical embodiments of this invention and are therefore not to be considered limiting of its scope, for the invention may admit to other equally effective embodiments.

DETAILED DESCRIPTION OF EMBODIMENTS OF THE INVENTION

Figure 1:
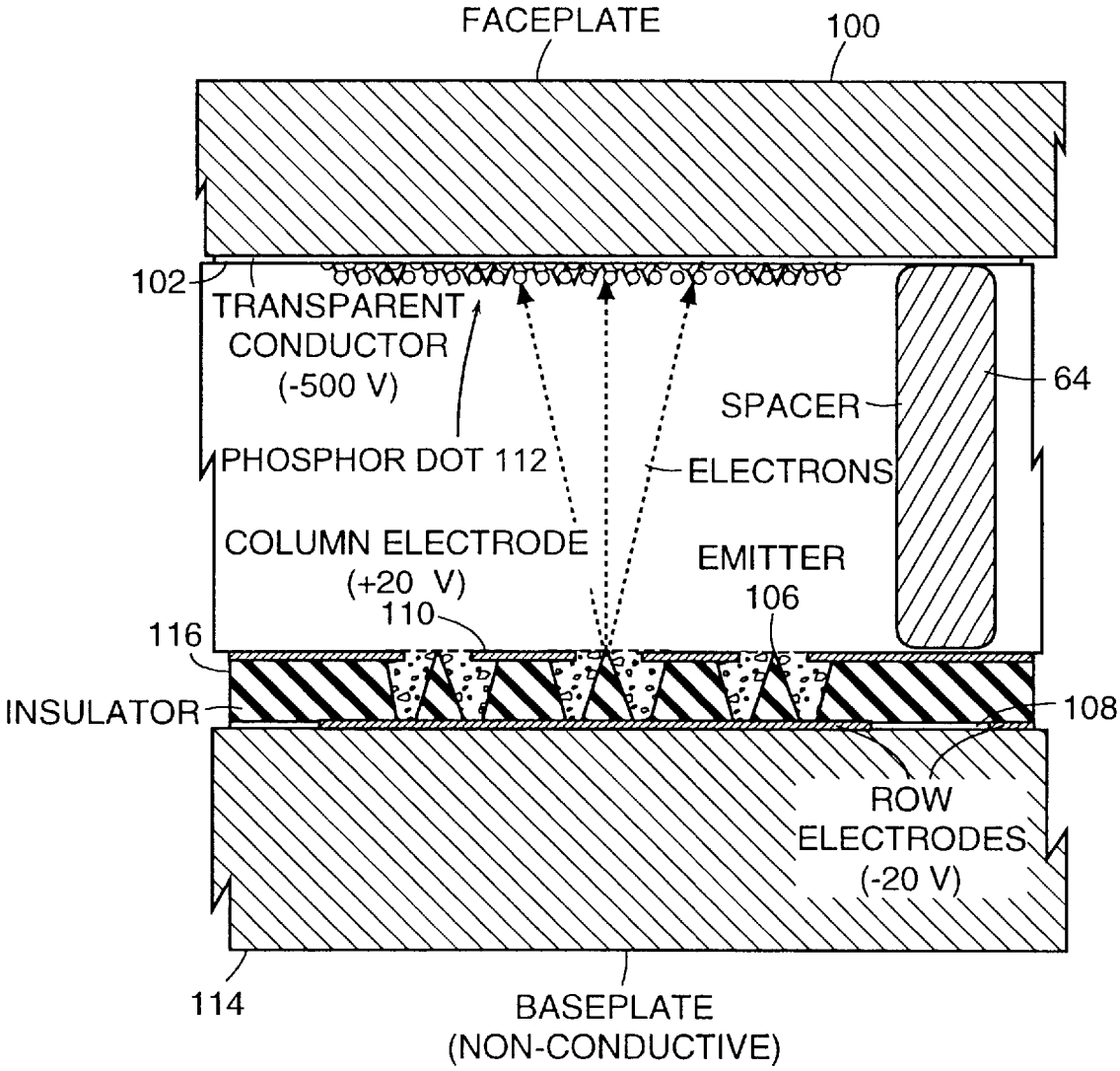
FIG. 1 is a plan view showing the operation of a typical FED device.
Figure 2A:
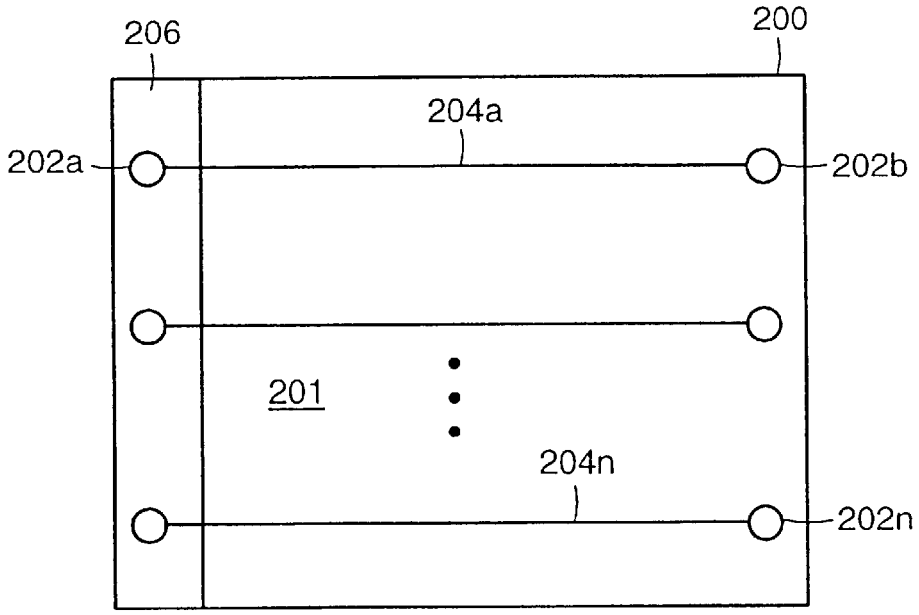
FIGS. 2A and 2B are, respectively, top and side views of a substrate according to an embodiment of the invention.
Figure 3:
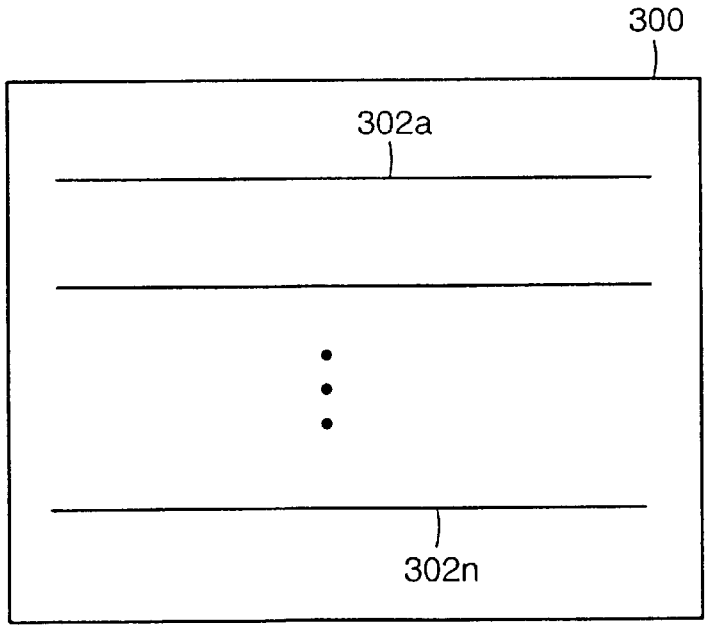
FIG. 3 is a top view of a substrate according to an embodiment of the invention.
Figure 2B:
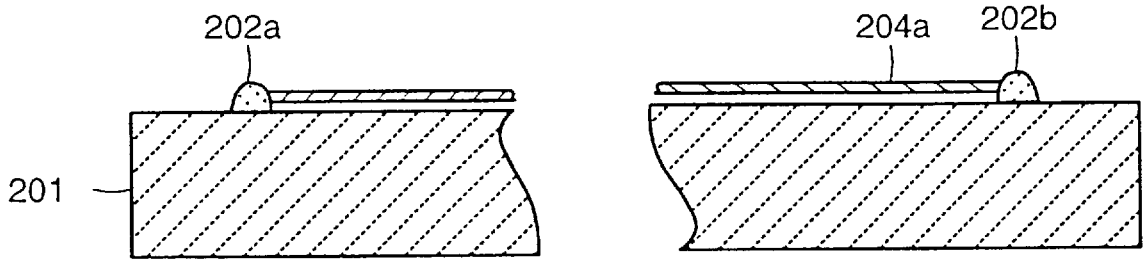

Referring now to FIGS. 2A and 2B, field emission display is provided having a substrate 200 comprising a plurality of attachments 202*a*–202*n* on a substrate surface 201, and a strengthening member 204*a*–204*n* disposed along the substrate surface 201 wherein the strengthening member 204*a*–204*n* is connected to the attachments 202*a*–202*n*. An example of a substrate 200 known to be useful with the present invention is soda-lime glass. Other types of glass known to be useful are, for example, Corning 7059. In other versions known to the invention, ceramics are used as a substrate 200. An example of a ceramic known to be useful with the present invention is Mullite.

As shown in the FIG. 2 embodiment, the strengthening members 204*a*–204*n* are disposed along the substrate surface 201. As used herein, the term "substrate surface" refers not only to the actual surface of the substrate 200 itself, but also to other adjacent surfaces suitable for placement of the attachments 202*a*–202*n*.

According to one embodiment of the invention, the attachments 202*a*–202*n* are comprised of a frit material. Examples of a suitable frit material is CF-7572 manufactured by Ferro Corp. The frit material, according to one aspect of the invention, is chosen so that its coefficient of thermal expansion ("CTE") is similar to that of the substrate

200. Selecting a frit material with a similar CTE to the substrate 200 provides the benefit of maintaining a suitable tension in the strengthening members.

Referring again to FIG. 2, in another embodiment of the invention, the attachments 202*a*–202*n* are disposed on the actual surface of the substrate 200. However, in another aspect, the attachments 202*a*–202*n* are formed on a surface 206 adjacent to the substrate 200. In this embodiment, it is possible to provide a frame on a perimeter edge of the substrate 200 to serve as a suitable surface for placing attachments 202*a*–202*n*.

According to another embodiment of the invention, the strengthening member 204*a*–204*n* comprises a wire. An example of a suitable wire is a metal wire. An example of an acceptable metal is platinum. Another example of an acceptable wire is a nickel/iron or nickel/iron/chrome alloy. An example of an acceptable wire diameter for use as a strengthening member is between about 0.01 inches and about 0.05 inches. The strengthening members 204*a*–204*n* are selected, according one embodiment, from materials which have a similar coefficient of thermal expansion as the substrate 200. In this way, as the substrate 200 is heated and cooled, the tension in the strengthening members 204*a*–204*n* will remain approximately constant. When the wires are in place, they are provided with a tension of between about 0.1 and about 1.0 pounds in order to provide an acceptable strengthening effect for the substrate 200.

According to another embodiment of the invention, the strengthening members 204*a*–204*n* comprise a strap. Examples of acceptable strap materials have been discussed. Another embodiment of the invention in which the strengthening member 202*a*–202*n* is actually embedded in the substrate 200. According to this embodiment, no attachments are required.

Figure 5:
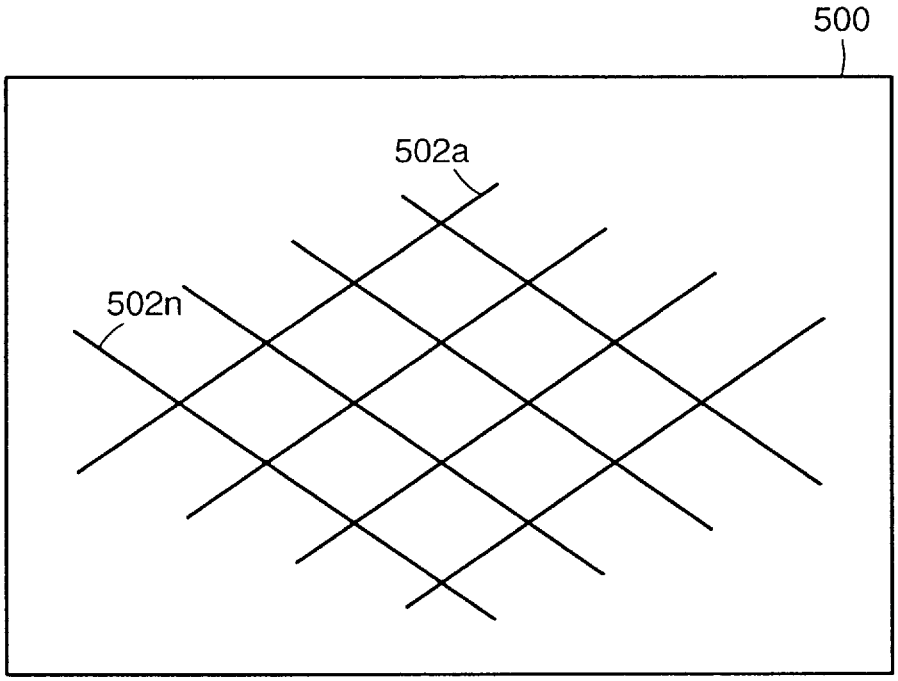
FIG. 5 is a side view of a substrate according to another embodiment of the invention.

FIG. 5 shows a further embodiment of the invention in which strengthening members 502*a*–502*n* are embedded in substrate 500. In this example, the geometry between the strengthening members 502*a*–502*n* is shown to be a plurality of intersecting lines. Persons of ordinary skill in the art will recognize that other geometries are possible, and that such geometries are useful with other aspects of the invention employing attachments.

Referring again to FIGS. 2A and 2B, a process for strengthening a substrate 200 of a field emission display is provided. In one embodiment, the process comprises, disposing a plurality of attachments 202*a*–202*b* on a substrate surface 201, disposing a strengthening member 204*a*–204*n* along the substrate surface 201, and connecting the strengthening member 204*a*–204*b* to the attachments 202*a*–202*b*. In one version of the invention, the step of disposing a plurality of attachments 202*a*–202*n* comprises disposing a frit material on the substrate surface 201. Examples of suitable frit material have been discussed previously. Those of skill in the art will recognize that there are several ways the frit could be applied to the substrate surface 201. For example, the frit can be heated to a temperature at which it becomes soft and sticky. It may then be applied to the substrate surface 201 and allowed to cool to a solid. In this case, the strengthening member may be embedded into the flit while it is soft. When the frit cools, the strengthening member will be permanently embedded therein.

In another embodiment of the invention, the step of disposing strengthening members 204*a*–204*n* comprises disposing a wire along the substrate surface 201. Alternately, the step of disposing strengthening members 202*a*–202*n* comprises placing a strap along the substrate surface 201.

In yet another embodiment of the invention, the process comprises embedding a strengthening 204*a* within the substrate. According to this embodiment, the substrate is heated to a point at which it becomes susceptible to the insertion of a strengthening 204*a*–204*n*, such as a strap or wire. After the strengthening member is embedded into the substrate, the substrate is allowed to cool thus encapsulating the strengthening member.

Figure 4:
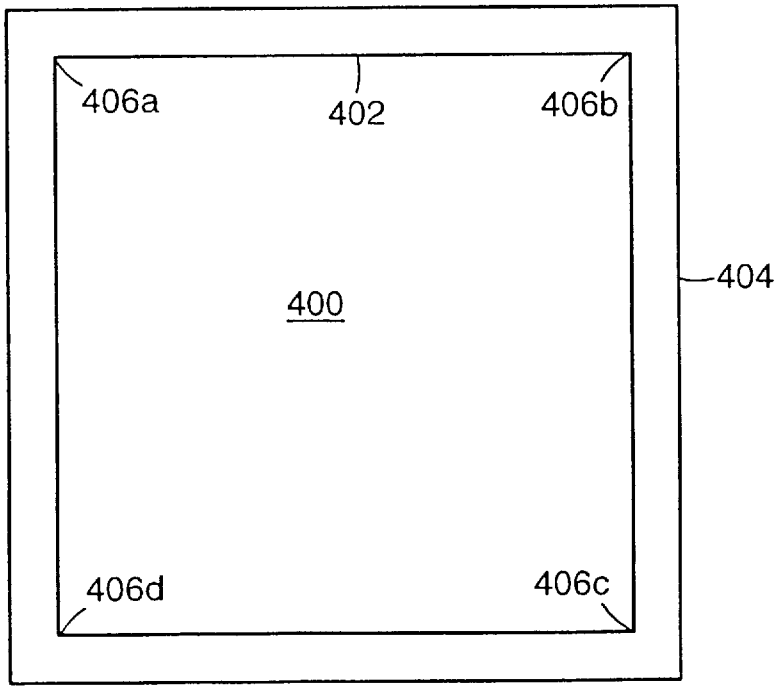
FIG. 4 is a top view of the substrate according to a further embodiment of the invention.

FIG. 4 shows another embodiment of the invention wherein a strap 402 is attached along the perimeter 404 of the substrate 400. The strap 402 is attached at one or more locations, preferably by one of the attachment methods discussed above. In this particular embodiment, the strap 402 is attached at each comer 406*a*–406*d* of the substrate.

What is claimed is:

1. A process for strengthening a backplate of a field emission display, the process comprising:

disposing frit material on a surface of the backplate;

heating the frit material to soften it and to form a plurality of attachments on a surface of the backplate;

disposing a strengthening member along the surface of the backplate; and attaching the strengthening member to the attachments.

2. A process as in claim 1 wherein disposing a frit material comprises disposing frit having a coefficient of thermal expansion similar to the coefficient of thermal expansion of the backplate.

3. A process as in claim 1 wherein disposing a strengthening member comprises disposing a wire.

4. A process as in claim 1 wherein disposing a strengthening member comprises disposing a strap.

5. A process as in claim 1 wherein disposing a strengthening member comprises disposing a member having a higher coefficient of thermal expansion than the backplate.

6. A process as in claim 1 wherein attaching the strengthening member comprises:

heating the frit to a softening temperature;

contacting the strengthening member with the frit while the frit is heated.

7. A field emission display having a substrate, comprising:

a plurality of attachments made from a frit material on a substrate surface;

a strengthening member disposed along the substitute surface, wherein the strengthening member is connected to the attachments.

8. A field emission display as in claim 7 wherein the frit material comprises frit having a coefficient of thermal expansion similar to the coefficient of thermal expansion of the backplate.

9. A field emission display as in claim 7 the strengthening member comprises a wire.

10. A field emission display as in claim 7 wherein the attachments are disposed on a surface adjacent to the substrate.

11. A field emission display as in claim 7 wherein the strengthening member comprises a strap.

12. A field emission display as in claim 7 wherein the strengthening member comprises a member having a higher coefficient of thermal expansion than the substrate.

* * * * *